United States Patent [19]

Jecker

[11] 4,437,888

[45] Mar. 20, 1984

[54] PREPARATION OF TITANIUM/ALUMINUM ALLOYS

[75] Inventor: Gilbert Jecker, Schiltigheim, France

[73] Assignee: Rhone-Poulenc Specialites Chimiques, Courbevoie, France

[21] Appl. No.: 375,099

[22] Filed: May 5, 1982

[30] Foreign Application Priority Data

May 6, 1981 [FR] France ..... 81 08975

[51] Int. Cl.[3] ..... C22C 14/00

[52] U.S. Cl. ..... 75/84.4; 420/417; 420/418; 420/420; 420/421

[58] Field of Search ..... 75/84.4, 84.5, 175.5, 75/257, 68 B; 423/72, 84, 492; 420/418, 419, 420, 421, 417

[56] References Cited

U.S. PATENT DOCUMENTS

| | | | |
|---|---|---|---|
| 1,437,984 | 12/1922 | Marden | 75/84.5 |
| 2,654,670 | 10/1953 | Davis | 75/257 |
| 2,766,113 | 10/1956 | Chisholm | 75/84.5 |
| 2,781,261 | 2/1957 | Kamlet | 75/84.4 |
| 2,823,991 | 2/1958 | Kamlet | 75/84.4 |
| 2,837,426 | 6/1958 | Kamlet | 75/84.4 |
| 3,455,678 | 7/1969 | Shapiro | 75/84.4 |
| 3,721,547 | 3/1973 | Dvorak | 75/257 |
| 3,839,020 | 10/1974 | Honma | 75/84.5 |
| 3,856,511 | 12/1974 | Becker | 75/68 B |
| 3,935,004 | 1/1976 | Faunce | 75/257 |
| 4,108,645 | 8/1978 | Mitchell et al. | 420/418 |
| 4,235,632 | 11/1980 | Uher | 75/257 |
| 4,290,809 | 9/1981 | Loane | 75/257 |

FOREIGN PATENT DOCUMENTS

| | | | |
|---|---|---|---|
| 835497 | 5/1960 | United Kingdom | 75/84.5 |
| 350848 | 9/1972 | U.S.S.R. | 75/257 |
| 580229 | 11/1977 | U.S.S.R. | 75/257 |

*Primary Examiner*—L. Dewayne Rutledge
*Assistant Examiner*—J. J. Zimmerman
*Attorney, Agent, or Firm*—Burns, Doane, Swecker & Mathis

[57] ABSTRACT

Alloys comprising titanium and aluminum, or titanium, aluminum and at least one of the metals M, wherein M is vanadium, zirconium, chromium, niobium, tantalum and/or iron, are facilely prepared by reducing an alkali metal fluotitanate, or coreducing admixture of an alkali metal fluotitanate and at least one halide of a metal M, with aluminum, in the presence of an alkali metal oxide reactive flux, either $Na_2O$ and/or $K_2O$; next solubilizing with water the fluorine compounds of reduction/coreduction which are in admixture of reduction/coreduction with dispersion of the aforesaid metals in metallic state; separating said dispersion of metals in metallic state from said admixture of reduction/coreduction; and then alloying by melting and cooling said separated dispersion of metals in metallic state.

28 Claims, No Drawings

PREPARATION OF TITANIUM/ALUMINUM ALLOYS

BACKGROUND OF THE INVENTION

1. Field of the Invention

The present invention relates to the preparation of alloys comprising titanium and aluminum, and also relates to the preparation of alloys comprising titanium, aluminum and at least one of the following metals: vanadium, molybdenum, zirconium, chromium, niobium, tantalum and iron.

The invention more especially relates to the preparation of alloys based on titanium and aluminum by coreduction in the presence of a reactive flux.

2. Description of the Prior Art

It is known to this art, i.e., from U.S. Pat. No. 1,437,984, to prepare pure metals, in particular zirconium, by the reduction of potassium fluozirconate with aluminum.

According to such process, a less than stoichiometric amount of the reducing metal is employed, which results in pure zirconium, i.e., free of the reducing metal. The reduction reaction is initiated by high frequency heating at a temperature between 600° C. and 700° C., a temperature at which the products of reaction, aluminum fluoride, potassium fluoride and residual potassium fluozirconate, do not evaporate. In a second stage, the reaction mass is heated to a temperature in excess of 1000° C., which gives rise to the evaporation of the reaction products, together with the excess of potassium fluozirconate. This process, however, displays the disadvantage in that it results in a significant loss of potassium fluozirconate by evaporation. Furthermore, the separation of the reaction products is very difficult.

SUMMARY OF THE INVENTION

Accordingly, a major object of the present invention is the provision of an improved process for the alloying of titanium and aluminum, or for preparing alloys based on titanium and aluminum, without the loss of the corresponding fluorine derivatives, and which process otherwise avoids those disadvantages and drawbacks above outlined.

Briefly, the present invention features a process for the preparation of alloys of titanium and aluminum by the reduction with aluminum of a mixture of an alkali metal fluotitanate in the presence of an alkali metal oxide reactive flux, either $Na_2O$ and/or $K_2O$.

This invention also features a process for the preparation of alloys of titanium, aluminum and at least one metal M, wherein M is at least one of the metals vanadium, zirconium, chromium, niobium, tantalum and/or iron, by means of the coreduction with aluminum of a mixture of an alkali metal fluotitanate and one or more of the halides of the metals M to constitute the final alloy composition in the presence of an alkali metal oxide reactive flux, also either $Na_2O$ and/or $K_2O$.

DETAILED DESCRIPTION OF THE INVENTION

More particularly according to this invention, the amount of aluminum employed consistent herewith corresponds to the sum of that amount required for the subject reduction or coreduction, together with that amount required to provide the final alloy composition desired.

Moreover, the addition of the reagents and the proportion of the flux is controlled such that the molecular ratio of the alkali metal oxide employed to the aluminum trifluoride formed during the reduction or coreduction is greater than or equal to 2, and preferably ranges from 2 to 3.

The temperature of the reduction or coreduction reaction is selected such that the products constituting the reaction mass do not evaporate. In general, a temperature ranging from 700° C. to 1000° C. is appropriate. It is preferred to carry out the reaction at a temperature ranging from 750° C. to 950° C., and more preferably from 925° C. to 950° C.

The reaction is carried out in an inert atmosphere, preferably under a blanket argon, at atmospheric pressure.

The process according to the present invention enables obtainment, in a first stage, of a fine dispersion of the metals constituting desired alloy, mixed with fluorine derivatives. In a second stage, separation of the pure metallic fraction from the fluorine derivatives is effected, after having solubilized the latter in an aqueous solution. The solution of the fluorine derivatives resulting from said solubilization operation then contains an alkali metal aluminate and an alkali metal fluoride. In a third stage, this solution may be treated with a mineral acid, such as sulfuric acid or hydrofluoric acid to yield a cryolite type combination that may be used as a flux in the production of aluminum by electrolysis.

The process according to the invention thus makes it possible to obtain, by means of a succession of simple stages, alloys based on titanium and aluminum, and it also results in a by-product which is readily marketed industrially.

The aluminum is preferably introduced in powdered form.

The fluotitanate employed is preferably sodium fluotitanate in anhydrous state; it too is preferably employed in a finely divided state.

The halide of the metal M is advantageously a fluoride or an anhydrous chloride in a finely divided state; a fluoride is preferably utilized.

In another embodiment of the invention, alloys may also be prepared which contain molybdenum and/or tin, in addition to the titanium, aluminum and optionally at least one of the metals M. In this case, the molybdenum and/or the tin are introduced in the metallic state.

In yet another embodiment of the invention, it too is envisaged to prepare alloys additionally comprising silicon. In this case, the silicon is introduced in the form of a silicon powder.

The alkali metal oxide constituting the reactive flux too is introduced in a finely divided state. Preferably, it comprises the same cation as the fluotitanate. Also preferably, sodium oxide is utilized.

And in a preferred embodiment of the invention, the reagents and the reactive flux are introduced into appropriate reactor, under an argon atmosphere, heated by high frequency heating means.

Following the reaction, the reaction mass is transferred under an argon atmosphere into a second reactor.

These operations may be effected continuously or discontinuously, several times, in order to obtain a reaction mass consisting of the mixture resulting from the several operations or obtained continuously.

After cooling the total reaction mass obtained, same is treated with an aqueous solution until the complete dissolution of the alkali metal aluminate and the alkali metal fluoride results.

In this manner, a fine dispersion of the metals constituting the desired alloy is obtained, together with an aqueous solution that is easily separated.

The metallic fraction, following its analysis and the optional addition of metallic powder to provide the exact amounts required for the final alloys, is subsequently melted to yield the alloy desired.

The aqueous solution is next treated with a solution of a strong mineral acid, such as hydrofluoric acid or sulfuric acid, whereby a cryolite type flux is precipitated, which, after optional adjustment of the respective amounts of $AlF_3$ and NaF, may be used in the electrolysis of aluminum. The most typically employed fluxes are: sodium cryolite, $AlF_3$, 3NaF; $AlF_3$, 2.2NaF and the chiolite 5/3 NaF.$AlF_3$ One of the advantages of the process according to the invention thus consists of the perfect integration at but a single situs of the production of cryolite type fluxes, an important raw material useful for the production of aluminum by electrolysis. Another advantage of the subject process resides in the fact that all of the raw materials are dry products, in a finely divided powder form and thus are readily utilized.

In order to further illustrate the present invention and the advantages thereof, the following specific examples are given, it being understood that same are intended only as illustrative and in nowise limitative.

EXAMPLE 1

This example describes the preparation of an alloy of titanium and aluminum, having a composition by weight of 95% titanium and 5% aluminum.

In a first step, a compressed mass containing 82.37 g sodium fluotitanate, 15.27 g aluminum powder and 7.2 g sodium oxide was introduced into a reactor. The installation was designed such that the reaction was carried out under an argon atmosphere and at atmospheric pressure.

This reaction mass was subsequently heated by high frequency heating means. A graphite sleeve enveloped the reactor and enabled attainment of a temperature of 950° C., which was controlled such that the temperature did not exceed this value. This temperature of 950° C. was maintained for approximately twenty minutes. The entire reaction mass was then transferred under argon into a separate reactor and allowed to cool. Five identical successive operations were carried out and the respective reaction masses were combined in a separate reactor.

By the treatment with water of the entire reaction mass obtained, an aqueous solution containing sodium hydroxide, sodium aluminate and sodium fluoride, and a metal powder, were obtained, the latter being separated and then dried. The weight of the metal powder was 98.8 g, of which 94.2 g were titanium and 4.6 g aluminum.

To this powder, 0.8 g titanium powder and 0.4 g aluminum powder were added, such as to provide the exact composition of the desired alloy. The mixture was then melted under an argon atmosphere to provide the alloys desired.

The metal powder obtained may also be used in the preparation of more complex alloys, and in particular those containing tin, molybdenum, silicon, with such additives being introduced in powder form.

The alkaline aqueous solution obtained was neutralized with 560 g sulfuric acid and a cryolite type precipitate was recovered which contained 220 g $AlF_3$ and 160 g NaF; 800 g $Na_2SO_4$ remained in solution. The precipitate was well adapted for the preparation of the cryolite presently used for the electrolysis of aluminum, as an alumina flux.

EXAMPLE 2

This example describes the preparation of an alloy having the composition: 90% titanium, 6% aluminum and 4% vanadium, all by weight.

Into the reactor, in a first operation, a compressed mass containing 78.04 g sodium fluotitanate, 16.84 g aluminum powder, 1.69 g vanadium trifluoride and 70 g sodium oxide (pure), were introduced. The installation was designed such that the reaction was conducted under argon and at normal pressure.

The reaction mass was then heated by high frequency heating means. A graphite sleeve enveloped the reactor which enabled attainment of a temperature of 950° C., which was controlled such that the temperature did not exceed this value. This temperature of 950° C. was maintained for approximately 20 minutes. Subsequently, the entire reaction mass was transferred under argon into a separate reactor and allowed to cool. Five identical, successive operations were then carried out and the reaction masses were recovered and combined in a separate reactor.

By treating the entire reaction mass thus obtained with water, an aqueous solution containing sodium hydroxide, sodium aluminate and sodium fluoride, and a metal powder, was obtained; the metal powder was separated therefrom and dried. The weight of the metal powder was 98.8 g, corresponding to an amount of titanium of 89.5 g, of aluminum of 5.5 g and of vanadium of 3.8 g. In order to provide the composition desired for the final alloy, 0.467 g aluminum powder and 0.178 g vanadium powder were added to the metal powder obtained, which was then remelted under argon. After three remelts, an alloy was obtained, the composition of which corresponded to the commercial $Ti_{90}Al_6V_4$ alloy.

The aqueous solution containing the sodium aluminate, the hydroxide and the sodium fluoride, was next treated with 560 g sulfuric acid and a cryolite type precipitate was collected, while 800 g $N_2SO_4$ remained in solution. After separation and drying of the precipitate, a mixture of 365 g containing approximately 57.5% $AlF_3$ and 42.5% sodium fluoride, was obtained. This by-product was well adapted for the preparation of cryolite, used presently in the electrolysis of aluminum, as an alumina flux.

EXAMPLE 3

This example describes the preparation of the more complex alloy having the composition: 88.2% Ti, 6% Al, 0.5% Mo, 5% Zr and 0.5% Si, all by weight.

An alloy powder corresponding to a composition of 88.2% Ti, 6% Al, 5% Zr, was prepared in a manner similar to that of the preceding examples, by coreduction in five successive operations of the following mixture: 88.45 g potassium fluotitanate, 14.85 g aluminum powder, 3.10 g potassium fluozirconate, and 105 g $K_2O$. There was obtained a powder containing: 87 g Ti, 5.5 g Al and 4.8 g Zr. To this powder, 0.5 g Al, 05 g Mo and 0.5 g silicon and 0.2 g Zr and 1.2 g Ti, in powder form, were added. The combination, after mixing, was compacted and remelted twice. An alloy having the desired composition was obtained.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims.

What is claimed is:

1. A process for the production of an admixture of metals in metallic state and a cryolite mineral comprising (1) reducing an alkali metal fluotitanate with aluminum at an elevated temperature which is below that at which vaporization of products of said reduction occurs, said reduction occurring in the presence of an alkali metal oxide reactive flux, (2) solubilizing with water fluorine compounds formed during said reduction which are in admixture with a dispersion of metallic titanium and aluminum also formed during said reduction, (3) separating said titanium and aluminum from said aqueous solution of solubilization of step (2), (4) contacting said aqueous solution of solubilization from which said metallic titanium and aluminum have been separated with a mineral acid to form a cryolite mineral, and (5) recovering said cryolite mineral.

2. The process as defined by claim 1, said alkali metal oxide reactive flux being selected from the group consisting of $Na_2O$, $K_2O$ and mixtures thereof.

3. A process for the preparation of an alloy comprising titanium and aluminum, which comprises melting and cooling the metallic titanium and aluminum separated by the process as defined by claim 1.

4. The process as defined by claim 3, further comprising adding, prior to the melting of said titanium and aluminum, an amount of powdered aluminum, titanium, or admixture thereof, so as to provide the exact composition of the final alloy desired.

5. The process as defined by claim 3, further comprising adding, prior to the melting of said titanium and aluminum, an amount of powdered tin, molybdenum, silicon or admixture thereof.

6. The process as defined by claim 3, wherein the molecular ratio of the alkali metal oxide reactive flux to the aluminum trifluoride formed during the reduction or coreduction is at least 2.

7. The process as defined by claim 6, said molecular ratio ranging from 2 to 3.

8. The process as defined by claim 6, said reduction or coreduction being carried out at a temperature ranging from 700° C. to 1000° C., under an inert atmosphere.

9. The process as defined by claim 8, said inert atmosphere comprising argon.

10. The process as defined by claim 8, said temperature ranging from 750° C. to 950° C.

11. The process as defined by claim 10, said temperature ranging from 925° C. to 950° C.

12. The process as defined by claim 6, said wherein aluminum, fluotitanate, M halide and alkali metal oxide reactive flux are introduced to the reduction or coreduction in finely divided powder form.

13. The process as defined by claim 12, said fluotitanate being sodium fluotitanate and said reactive flux being $Na_2O$.

14. The process as defined by claim 13, said M halide being a fluoride.

15. The process as defined by claim 12, the final product alloy being $Ti_{90}Al_6V_4$.

16. A process for the production of an admixture of metals in metallic state and a cryolite mineral comprising (1) coreducing an admixture of an alkali metal fluotitanate, aluminum and at least one halide of a metal M wherein M is selected from the group consisting of vanadium, zirconium, chromium, niobium, tantalum and iron at an elevated temperature which is below that at which vaporization of products of said coreduction occurs, said coreduction occurring in the presence of an alkali metal oxide reactive flux, (2) solubilizing with water fluorine compounds formed during said reduction which are in admixture with a dispersion of metals in metallic state also formed during said reduction, (3) separating said metals in metallic state from said aqueous solution of solubilization of step (2), (4) contacting said aqueous solution of solubilization from which said metallic titanium and aluminum have been separated with a mineral acid to form a cryolite mineral, and (5) recovering said cryolite mineral.

17. The process as defined by claim 16, said alkali metal oxide reactive flux being selected from the group consisting of $Na_2O$, $K_2O$ and mixtures thereof.

18. A process for the preparation of an alloy comprising titanium and aluminum, which comprises melting and cooling that dispersion of metals in metallic state separated by the process as defined by claim 17.

19. The process as defined by claim 18, further comprising adjusting the composition of said dispersion of metals, prior to the melting thereof, with an amount of powdered aluminum, titanium, or admixture thereof, so as to provide the exact composition of the final alloy desired.

20. The process as defined by claim 18, further comprising adjusting the composition of said dispersion of metals, prior to the melting thereof, with an amount of powdered tin, molybdenum, silicon, or admixture thereof.

21. The process as defined by claim 18, wherein the molecular ratio of the alkali metal oxide reactive flux to aluminum trifluoride formed during the reduction or coreduction is at least 2.

22. The process as defined by claim 21, said molecular ratio ranging from 2 to 3.

23. The process as defined by claim 21, said reduction or coreduction being carried out at a temperature ranging from 700° C. to 1000° C. under an inert atmosphere.

24. The process as defined by claim 23, said temperature ranging from 750° C. to 950° C.

25. The process as defined by claim 24, said temperature ranging from 925° C. to 950° C.

26. The process as defined by claim 23, said inert atmosphere comprising argon.

27. The process as defined by claim 20, wherein said aluminum, fluotitanate and alkali metal oxide reactive flux are introduced to the reduction or coreduction in finely divided powder form.

28. The process as defined by claim 27, said fluotitanate being sodium fluotitanate and said reactive flux being $Na_2O$.

* * * * *